US005695122A

United States Patent [19]

Messinger

[11] Patent Number: 5,695,122

[45] Date of Patent: Dec. 9, 1997

[54] GEAR-TYPE ROTARY SPRINKLER

[75] Inventor: Daniel Messinger, Migdal Haemek, Israel

[73] Assignee: Plastro Gvat, Doar Gvat, Israel

[21] Appl. No.: 555,022

[22] Filed: Nov. 8, 1995

[30] Foreign Application Priority Data

Nov. 16, 1994 [IL] Israel ..... 111651

[51] Int. Cl.[6] ..... B05B 3/04

[52] U.S. Cl. ..... 239/240; 239/242; 239/263.3

[58] Field of Search ..... 239/237, 240–2, 239/263.3, 255, 251, 394, DIG. 1

[56] References Cited

U.S. PATENT DOCUMENTS

| | | | |
|---|---|---|---|
| 2,253,979 | 8/1941 | Lacy-Mulhall | 239/67 |
| 3,038,666 | 6/1962 | Dudley et al. | 239/241 |
| 3,093,313 | 6/1963 | Salimen | 239/240 |
| 3,107,056 | 10/1963 | Hunter | 239/206 |
| 3,623,667 | 11/1971 | Costa | 239/237 |
| 3,713,584 | 1/1973 | Hunter | 239/206 |
| 3,902,670 | 9/1975 | Koller et al. | 239/307 |
| 3,915,383 | 10/1975 | King | 239/242 |
| 4,133,344 | 1/1979 | Hunter et al. | 137/344 |
| 4,255,987 | 3/1981 | Ciolli | 74/68 |
| 4,501,391 | 2/1985 | Hunter | 239/97 |
| 4,708,290 | 11/1987 | Osmond | 239/227 |
| 4,744,517 | 5/1988 | Iwamoto et al. | 239/263 |
| 4,811,902 | 3/1989 | Nagata | 239/240 |
| 4,850,247 | 7/1989 | Yu | 74/785 |
| 5,031,833 | 7/1991 | Alkalay et al. | 239/68 |
| 5,048,757 | 9/1991 | Van Leeuwen | 239/205 |
| 5,052,621 | 10/1991 | Katzer et al. | 239/242 |
| 5,115,977 | 5/1992 | Alkalay et al. | 239/68 |
| 5,174,501 | 12/1992 | Hadar | 239/205 |
| 5,288,023 | 2/1994 | Han et al. | 239/242 |
| 5,330,103 | 7/1994 | Eckstein | 239/242 |
| 5,383,600 | 1/1995 | Verbera et al. | 239/205 |
| 5,417,370 | 5/1995 | Kah, Jr. | 239/242 |

*Primary Examiner*—Andres Kashnikow
*Assistant Examiner*—Lisa Ann Douglas
*Attorney, Agent, or Firm*—Benjamin J. Barish

[57] ABSTRACT

A rotary sprinkler has a step-down transmission between a turbine wheel drive and the sprinkler nozzle, which transmission includes a fixed ring gear having internal teeth coaxial with the drive rotary axis; a planet gear having external teeth engageable with, but fewer in number than, the internal teeth of the ring gear; and an eccentric pin secured to the rotary drive at its rotary axis and having a central axis laterally of the drive rotary axis. The eccentric pin is received within an opening centrally of the planet gear to cause the planet gear to planetate around the fixed ring gear and to rotate around the drive rotary axis at a step-down velocity determined by the difference in the number of teeth between the ring gear and the planet gear.

20 Claims, 4 Drawing Sheets

GEAR-TYPE ROTARY SPRINKLER

FIELD AND BACKGROUND OF THE INVENTION

The present invention relates to rotary sprinklers, and particularly to rotary sprinklers which include a gear drive for rotating the sprinkler.

Many gear-type rotary sprinklers are known. They generally include a rotary drive device (e.g., a turbine wheel) driven by the pressurized water supplied to the rotary sprinkler, and a step-down transmission between the turbine wheel and the water discharge device (e.g., a rotary nozzle or rotary distributor) in the sprinkler. When a turbine wheel is used as the rotary drive, the pressurized water rotates the turbine wheel at a relatively high velocity, in the order of 2,000 rpm. However, the sprinkler is to be rotated at a small faction of that velocity, in the order of 2–3 rpm. The known gear-type rotary sprinklers therefore generally include a relatively large number of gears in a bulky step-down transmission in order to step-down the rotational speed of the turbine wheel from about 2,000 rpm to about 2–3 rpm.

OBJECTS AND BRIEF SUMMARY OF THE INVENTION

An object of the present invention is to provide a rotary sprinkler of the gear type but which includes a simpler and more compact step-down transmission between the rotary drive device and the water discharge device.

According to the present invention, there is provided a rotary sprinkler, comprising: a housing having an inlet connectible to a water supply line for inletting pressurized water to the sprinkler; a rotary drive rotated by the inletted pressurized water at a relatively high velocity about a rotary axis; a rotatable water discharge device for discharging the water laterally around the sprinkler; and a step-down transmission between the rotary drive device and the water discharge device, characterized in that the transmission includes: a ring gear fixed to the housing and having a circular array of internal teeth coaxial with the rotary axis; a planet gear of smaller diameter than the ring gear and having a circular array of external teeth engageable with, but different in number than, the internal teeth of the ring gear; an eccentric pin secured to the rotary drive at its rotary axis thereof and having a central axis laterally of the rotary axis, the eccentric pin being received within an opening formed centrally of the planet gear such as to cause the planet gear to planetate around the fixed ring gear and to rotate around the rotary axis at a step-down velocity determined by the difference in the number of teeth between the ring gear and the planet gear; and a coupling from the planet gear to the water discharge device to rotate the water discharge device.

As will be described more particularly below, such an arrangement provides a compact construction which permits a relatively large step-down in the transmission to be produced in a single stage. It also permits the addition of further stages to produce a much larger step-down in the transmission if desired. Such a step-down transmission also produces a non-uniform, or jerky, movement of the rotary sprinkler, which is frequently advantageous to increase the range of the sprinkler.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
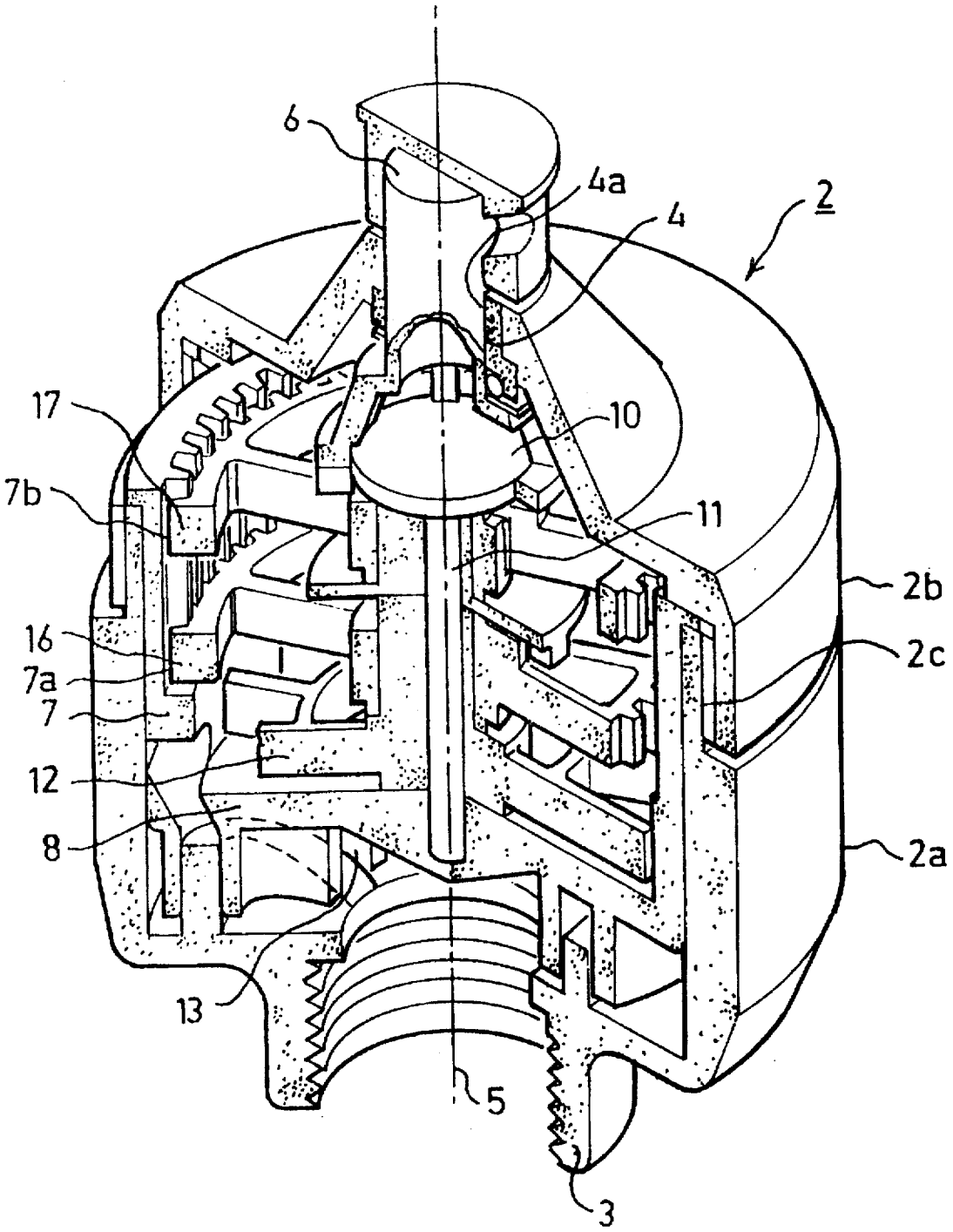
FIG. 1 is a three-dimensional breakaway view illustrating one form of rotary sprinkler constructed in accordance with the present invention.
Figure 2:
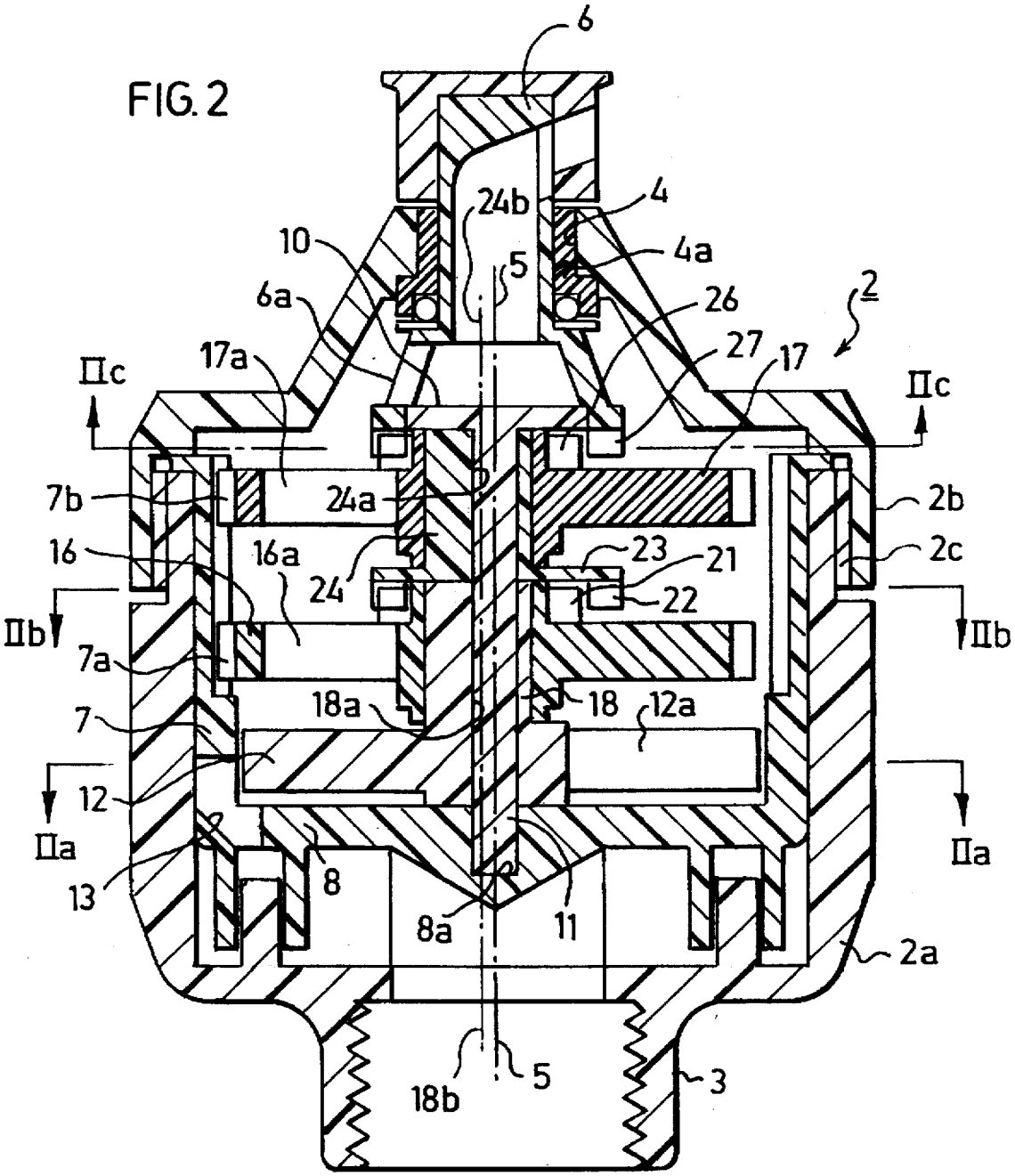
FIG. 2 is a longitudinal sectional view of the sprinkler of FIG. 1.

The rotary sprinkler illustrated in FIGS. 1 and 2 comprises a housing 2 constituted of two cylindrical half-sections 2*a*, 2*b* joined together by threads 2*c*. Housing section 2*a* is integrally formed with an inlet 3 connectible to a water supply line for supplying pressurized water to the sprinkler. Housing section 2*b* is formed with an opening 4 coaxial with the axis 5 of the housing, and lined with a bushing 4*a*, for receiving a nozzle 6 rotatable about axis 5 in order to distribute the water laterally around the sprinkler.

A ring gear unit 7 is fixed to the inner wall of housing section 2*a*. It includes an end wall 8 extending transversely of the housing and formed with a central recess 8*a* coaxial with the rotary axis 5 of nozzle 6. Ring gear unit 7 further includes two circular arrays 7*a*, 7*b* of internal teeth axially spaced from its end wall 8 and coaxial with rotary axis 5. Preferably, teeth 7*b* are axial extensions of teeth 7*a*.

Rotatable nozzle 6 is carried by a holder 10 formed with an elongated stem 11 rotatably received within recess 8*a* of ring gear end wall 8. Holder 10 and its nozzle 6 are rotated about rotary axis 5 by means of a rotary drive and a step-down transmission located within housing 2 and cooperable with the ring gear unit 7.

Figure 2A:
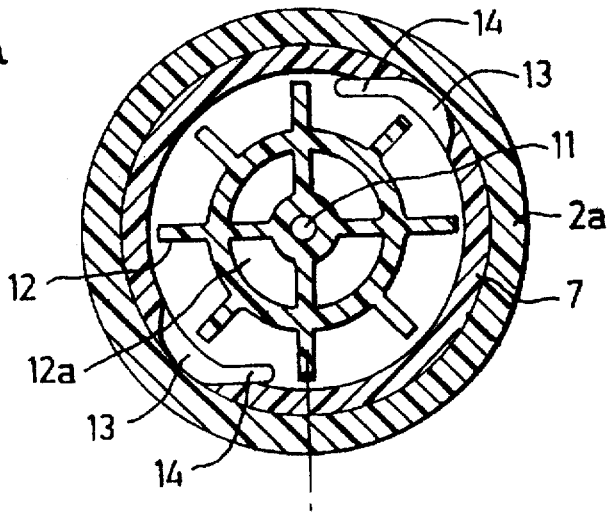
FIGS. 2*a*, 2*b* and 2*c* are transverse sectional views along lines IIa—IIa, IIb—IIb and IIc—IIc, respectively, of FIG. 2.
Figure 2B:
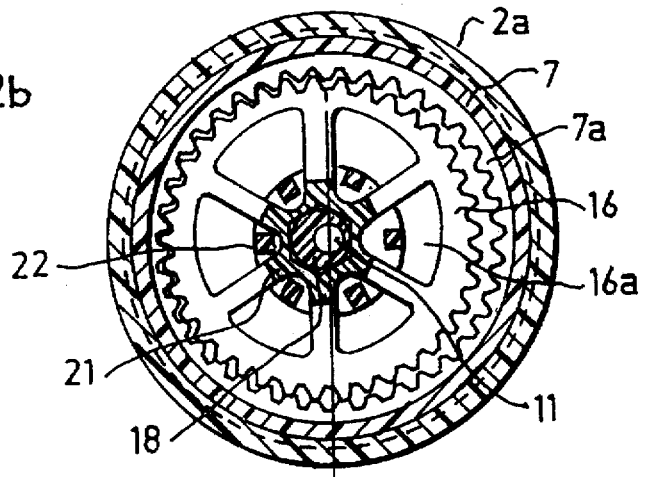
Figure 2C:
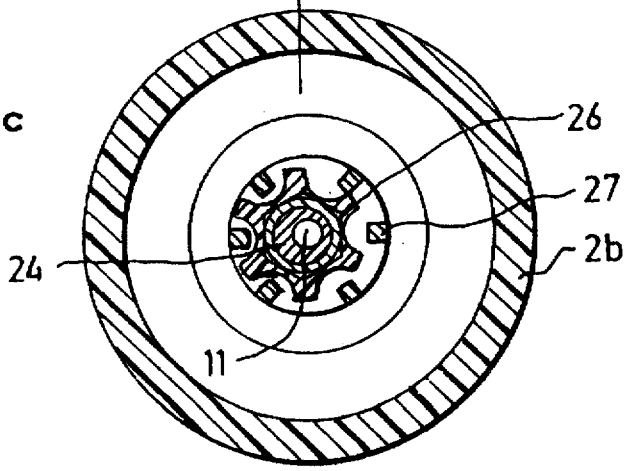

The rotary drive includes a rotatable turbine wheel 12 coaxial with rotary axis 5. Turbine wheel 12 is rotated by the pressurized water inletted via inlet 3, and passing through axial passageways 13 and tangential passageways 14 (FIG. 2*a*) aligned with the periphery of the turbine wheel.

A typical rotational velocity of turbine wheel 12 when driven by the pressurized water is in the order of 2,000 rpm. This high rotational velocity is stepped-down to the order of 2–3 rpm by the step-down transmission coupling the turbine wheel to the nozzle holder 10. In the example illustrated in FIGS. 1 and 2, the step-down transmission comprises two stages, namely: a first stage includes a first planet gear 16 cooperable with ring gear teeth 7*a*, and a second stage includes a second planet gear 17 cooperable with ring gear teeth 7*b*.

Planet gear 16 in the first stage is of smaller diameter than ring gear teeth 7*a* with which gear 16 is aligned, and includes a circular array of external teeth engageable with, but fewer in number than, ring gear teeth 7*a*. Planet gear 16 is eccentrically coupled to the turbine wheel 12 by an eccentric pin 18 secured to the turbine wheel at its rotary axis 5. Eccentric pin 18 includes a bore 18*a* having an axis 18*b* which is laterally of rotary axis 5. Pin 18 is received within a central opening in planet gear 16.

Eccentric pin 18 thus produces an eccentric coupling between the turbine wheel 12 and the planet gear 16 such that the rotation of the turbine wheel causes planet gear 16 to planetate around the fixed ring gear teeth 7*a* and also to rotate about the rotary axis 5 at a step-down velocity determined by the difference in the number of the ring gear teeth 7*a* with respect to the teeth in the planet gear 16.

This step-down rotation of the first-stage planet gear 16 is transmitted to the second-stage planet gear 17 by a plurality of pins 21 carried by planet gear 16 engageable with pins 22 depending from a coupling member 23 cooperable with planet gear 17.

Coupling member 23 includes a second eccentric pin 24 fixed thereto at the rotary axis 5 but formed with a bore 24*a* having an axis 24*b* laterally of rotary axis 5. Eccentric pin 24 is received within a central opening in planet gear 17. Planet gear 17 is also of smaller diameter than the circular array of ring gear teeth 7*b* and also includes a fewer number of external teeth as compared to the internal teeth 7*b* of ring gear 7.

Eccentric pin 24 will thus rotate with planet gear 16. It will cause planet gear 17 to planetate around the fixed ring gear teeth 7*b* and also to rotate around the rotary axis 5 at a stepped-down velocity, determined by the difference in the number of teeth between planet gear 17 and ring gear teeth 7*b*. The direction of rotation of planet gear 17 will be opposite to that of planet gear 16.

The rotation of planet gear 17 is coupled to nozzle holder 10 by a plurality of coupling pins 26 carried by planet gear 17 engageable with pins 27 depending from nozzle holder 10.

The rotary sprinkler illustrated in FIGS. 1 and 2 operates as follows:

The pressurized water at inlet 3 passes via axial passageways 13 and tangential passageways 14 (FIG. 2*a*) to rotate turbine wheel 12 at a relatively high velocity. These rotations of the turbine wheel are conveyed by eccentric pin 18 to planet gear 16, causing the planet gear to planetate around ring gear teeth 7*a* and to rotate about rotary axis 5 at a step-down velocity according to the difference in the number of teeth between planet gear 16 and ring gear teeth 7*a*. The rotation of planet gear 16 about axis 5 is transmitted by pins 21 and 22 to coupling member 23. Eccentric pin 24 of coupling member 23 transmits these rotations to planet gear 17, causing planet gear 17 to planetate around ring gear teeth 7*b* and also to rotate about rotary axis 5 at a further step-down velocity determined by the difference in the number of teeth between these two gears. The rotation of the second-stage planet gear 17 is transmitted to nozzle 6 by pins 26 and 27.

Nozzle 6 thus rotates at a step-down velocity which is the product of the step-down transmission ratio produced by the first-stage planet gear 16 multiplied by the step-down transmission ratio produced by the second-stage planet gear 17. As the nozzle is thus rotated, the water is discharged therefrom via a flowpath from the inlet 3, which includes openings 12*a*, 16*a*, 17*a* and 6*a* in turbine wheel 12, planet gear 16, planet gear 17 and nozzle 6, respectively.

As one example, ring gear teeth 7*a* and 7*b* is constituted of two portions of a common ring gear unit formed with forty internal teeth; planet gear 16 includes 39external teeth; and planet gear 17 includes 38 external teeth. In this example, the first-stage reduction would be 39:1, and the second-stage reduction would be 19:1, so that the product of the two stages would be 741:1. Thus, if turbine wheel 12 is rotated 2,000 rpm, nozzle 6 would be rotated, in the same direction, at about 2.7 rpm.

The arrangement illustrated in FIG. 1 thus provides a large step-down transmission in a very compact construction. Moreover, this arrangement also produces a non-uniform, or jerky, movement of the rotary sprinkler since the rotations of the two planet gears 16, 17 will not be uniform. Such a jerky movement of a rotary sprinkler is generally advantageous since the low-velocity phases of the rotary movement tend to increase the range of the sprinkler.

Figure 3:
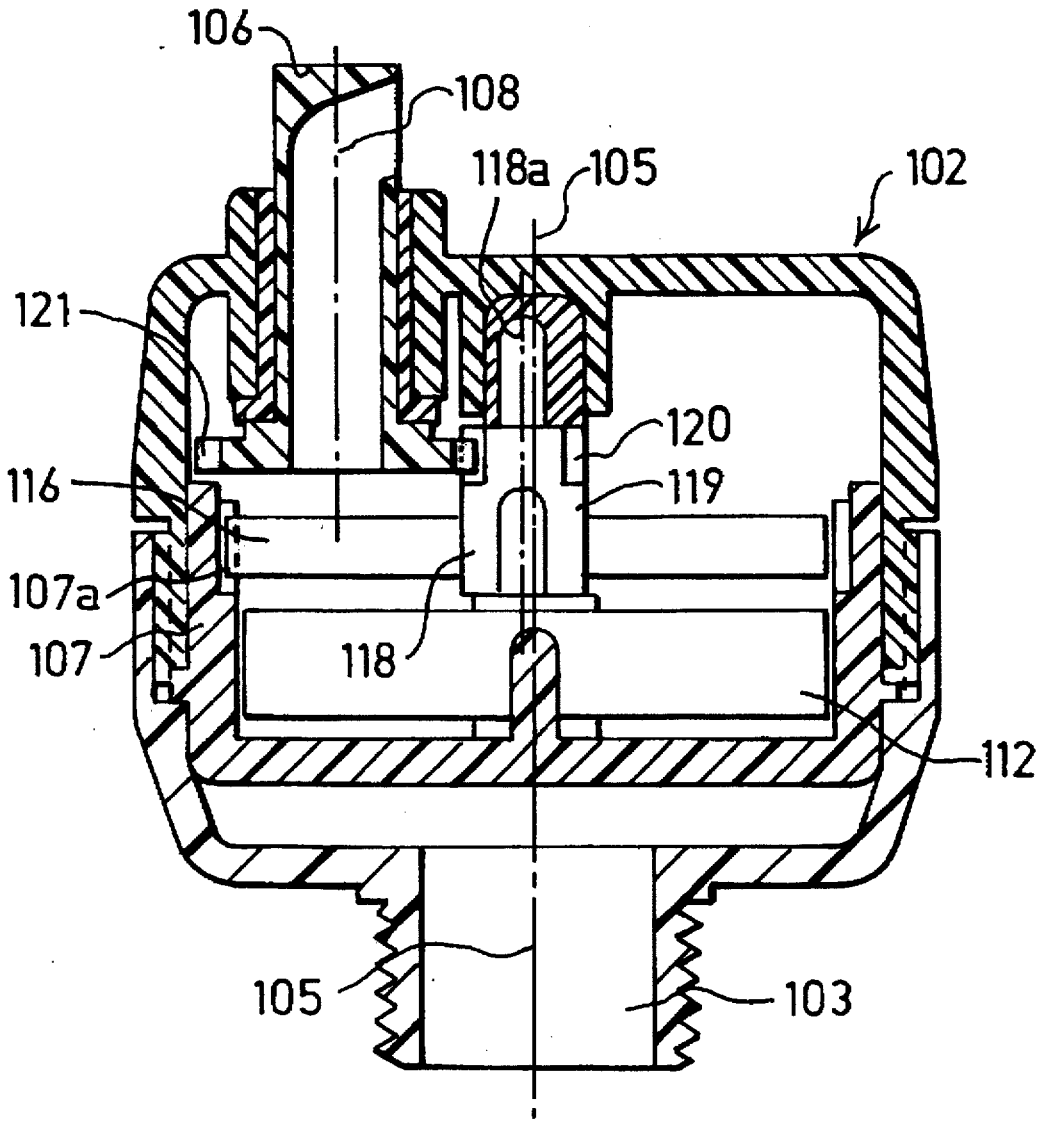
FIG. 3 is a longitudinal sectional view illustrating another rotary sprinkler constructed in accordance with the present invention.

FIG. 3 illustrates another rotary sprinkler constructed in accordance with the present invention, which also includes a housing 102 having an inlet 103, a rotatable nozzle 106, and a ring gear 107 secured to the inner face of housing 102. In this case, however, the rotary axis 108 of nozzle 106 is not the same as axis 105 of the housing turbine wheel drive 112 and the ring gear 107.

The sprinkler illustrated in FIG. 3 also includes a turbine wheel drive 112 rotated by the pressurized water introduced via inlet 103 and an eccentric pin 118 fixed coaxially with the drive and having an axis 118*a* laterally of the drive rotary axis 105. In this case, however, there is a single planet gear 116 having a central opening receiving eccentric pin 118. Planet gear 116 is also of smaller diameter and has a fewer number of external teeth than ring gear internal teeth 107*a*. Gear 116 is thus coupled to turbine wheel 112 by eccentric pin 118 such that the rotations of the turbine wheel cause the planet gear to planetate around the ring gear, and to rotate about axis 105 at a step-down velocity determined by the difference in number of teeth between the two gears, as described with respect to FIG. 1.

The step-down rotations of planet gear 116 are transmitted to nozzle 106 by a small-diameter gear 120 fixed to pin 119 of planet gear 116 meshing with a larger-diameter gear 121 fixed to the nozzle. Thus, rotation of nozzle 106 will be stepped-down by the transmission ratio between planet gear 116 and ring gear teeth 107 as described above with respect to FIG. 1, multiplied by the transmission ratio between the two gears 120 and 121.

While the invention has been described with respect to two preferred embodiments, it will be appreciated that these are set forth merely for purposes of example, and that many other variations, modifications and applications of the invention may be made.

I claim:

1. A rotary sprinkler, comprising:

a housing having an inlet connectible to a water supply line for inletting pressurized water to the sprinkler;

a rotary drive rotated by the inletted pressurized water at a relatively high velocity about a rotary axis;

a rotatable water discharge device for discharging the water laterally around the sprinkler;

and a step-down transmission between said rotary drive device and said water discharge device;

characterized in that said transmission includes:

a ring gear fixed to the housing and having a circular array of internal teeth coaxial with said rotary axis;

a planet gear of smaller diameter than said ring gear and having a circular array of external teeth engageable with, but different in number than, said internal teeth of the ring gear;

an eccentric pin secured to said rotary drive at said rotary axis thereof and having a central axis laterally of said rotary axis, said eccentric pin being received within an opening formed centrally of said planet gear such as to cause the planet gear to planetate around the fixed ring gear and to rotate around said rotary axis at a step-down velocity determined by the difference in the number of teeth between said ring gear and said planet gear;

and a coupling from said planet gear to said water discharge device to rotate said water discharge device.

2. The rotary sprinkler according to claim 1, wherein said planet gear has a fewer number of teeth than said ring gear.

3. The rotary sprinkler according to claim 1, wherein said rotary drive is a turbine wheel rotated by the pressurized water.

4. The rotary sprinkler according to claim 1, wherein said coupling from said planet gear to said water discharge device comprises a plurality of pins carried by said planet gear engageable with pins carried by a coupling member coupled to said water discharge device.

5. The rotary sprinkler according to claim 4, wherein said coupling member includes a second eccentric pin secured to said planet gear at said rotary axis and received within an opening formed centrally of a second planet gear having a circular array of external teeth engageable with, but of different number than, a second circular array of internal ring gear teeth fixed to the housing coaxial with said rotary axis such that the rotation of said second eccentric pin causes said second planet gear to planetate around said second circular array of fixed ring gear teeth at a further step-down velocity determined by the difference in the number of teeth between said second circular array of ring gear teeth and said second planet gear.

6. The rotary sprinkler according to claim 5, wherein said second circular array of ring gear teeth are axial extensions of the first-mentioned circular array of ring gear teeth.

7. The rotary sprinkler according to claim 5, wherein said coupling to said water discharge device further includes a second plurality of pins carried by said second planet gear engageable with further pins carried by a second coupling member coupled to said wager discharge device.

8. The rotary sprinkler according to claim 1, wherein said water discharge device includes a stem rotatably mounted coaxially to said ring gear and housing.

9. The rotary sprinkler according to claim 1, wherein said coupling from said planet gear to said water discharge device comprises a small-diameter gear fixed to said planet gear and driving a larger-diameter gear fixed to said water discharge device.

10. The rotary sprinkler according to claim 1, wherein said water discharge device is a rotary nozzle rotatably mounted to said housing.

11. A rotary sprinkler, comprising:

a housing having an inlet connectible to a water supply line for inletting pressurized water to the sprinkler;

a rotary drive rotated by the inletted pressurized water at a relatively high velocity about a rotary axis;

a rotatable nozzle for discharging the water laterally around the sprinkler;

and a step-down transmission between said rotary drive and said nozzle;

said transmission including:

a ring gear fixed to the housing and having a circular array of internal teeth coaxial with said rotary axis;

a planet gear of smaller diameter than said ring gear and having a circular array of external teeth engageable with, but fewer in number than, said internal teeth of the ring gear;

an eccentric pin secured to said rotary drive at said rotary axis thereof and having a central axis laterally of said rotary axis, said eccentric pin being received within an opening formed centrally of said planet gear such as to cause the planet gear to planetate around the fixed ring gear and to rotate around said rotary axis at a step-down velocity determined by the difference in the number of teeth between said ring gear and said planet gear;

and a coupling from said planet gear to said nozzle.

12. The rotary sprinkler according to claim 11, wherein said rotary drive is a turbine wheel rotated by the pressurized water.

13. The rotary sprinkler according to claim 12, wherein said coupling from said planet gear to said nozzle comprises a plurality of pins carried by said planet gear engageable with pins carried by a coupling member coupled to said nozzle.

14. The rotary sprinkler according to claim 13, wherein said coupling member includes a second eccentric pin secured to said planet gear at said rotary axis and received within an opening formed centrally of a second planet gear having a circular array of external teeth engageable with, but of fewer number than, a second circular array of internal ring gear teeth fixed to the housing coaxial with said rotary axis such that the rotation of said second eccentric pin causes said second planet gear to planetate around said second circular array of fixed ring gear teeth at a further step-down velocity determined by the difference in the number of teeth between said second circular array of ring gear teeth and said second planet gear.

15. The rotary sprinkler according to claim 14, wherein said second circular array of ring gear teeth are axial extensions of the first-mentioned circular array of ring gear teeth.

16. The rotary sprinkler according to claim 15, wherein said coupling to said nozzle further includes a second plurality of pins carried by said second planet gear engageable with further pins carried by a second coupling member coupled to said nozzle.

17. The rotary sprinkler according to claim 11, wherein said nozzle includes a stem rotatably mounted coaxially to said ring gear and housing.

18. The rotary sprinkler according to claim 1, wherein said coupling from said planet gear to said rotatable water discharge device comprises a small-diameter gear fixed to said planet gear and driving a larger-diameter gear fixed to said nozzle.

19. A rotary sprinkler, comprising:

a housing having an inlet connectible to a water supply line for inletting pressurized water to the sprinkler;

a turbine drive rotated by the inletted pressurized water at a relatively high velocity about a rotary axis;

a rotatable nozzle for discharging the water laterally around the sprinkler;

and a step-down transmission between said turbine rotary drive and said nozzle;

said transmission including:

a ring gear fixed to the housing and having a circular array of internal teeth coaxial with said rotary axis;

a planet gear of smaller diameter than said ring gear and having a circular array of external teeth engageable with, but of one number less than, said internal teeth of the ring gear;

an eccentric pin secured to said rotary drive at said rotary axis thereof and having a central axis laterally of said rotary axis, said eccentric pin being received within an opening formed centrally of said planet gear such as to cause the planet gear to planetate around the fixed ring gear and to rotate around said rotary axis at a step-down velocity determined by the difference in the number of teeth between said ring gear and said planet gear;

and a coupling from said planet gear to said water discharge device to rotate said nozzle.

20. The rotary sprinkler according to claim 19, wherein said coupling member includes a second eccentric pin secured to said planet gear at said rotary axis and received within an opening formed centrally of a second planet gear having a circular array of external teeth engageable with, but of one number less than, a second circular array of internal ring gear teeth fixed to the housing coaxial with said rotary axis such that the rotation of said second eccentric pin causes said second planet gear to planetate around said second circular array of fixed ring gear teeth at a further step-down velocity determined by the difference in the number of teeth between said second circular array of ring gear teeth and said second planet gear.

* * * * *